United States Patent [19]

Thomson et al.

[11] Patent Number: 4,810,173

[45] Date of Patent: Mar. 7, 1989

[54] FIREBOOSTER

[76] Inventors: Robert W. Thomson, Rte. 3, Box 63, Newland, N.C. 28657; George Spector, 233 Broadway, Rm. 3815, New York, N.Y. 10007

[21] Appl. No.: 49,156

[22] Filed: May 13, 1987

[51] Int. Cl.[4] ..... F04B 17/04; F23L 5/02

[52] U.S. Cl. ..... 417/411; 417/234; 126/25 B; 126/521

[58] Field of Search ..... 126/25 B, 146, 135; 417/234, 411; 431/254, 255; 239/587, 588, 602

[56] References Cited

U.S. PATENT DOCUMENTS

| | | | |
|---|---|---|---|
| 1,295,907 | 3/1919 | LeCompte | 126/25 B |
| 1,526,878 | 2/1925 | Stromeyer | 239/588 |
| 2,850,228 | 9/1958 | Rowley | 417/411 X |
| 2,950,669 | 8/1960 | Terry | 126/25 B X |
| 3,086,698 | 4/1963 | Goldstein | 126/25 B X |
| 3,099,386 | 7/1963 | Pieper | 126/25 B X |
| 3,347,220 | 10/1967 | Barbera | 126/25 B |
| 3,362,586 | 1/1968 | Dedoes | 126/25 B X |
| 3,647,323 | 3/1972 | Thomas | 126/25 B X |
| 3,697,198 | 10/1972 | Holder | 126/25 B X |
| 4,044,750 | 8/1977 | Zeigler | 126/25 B |
| 4,190,034 | 2/1980 | Wonisch | 126/25 B |
| 4,516,561 | 5/1985 | Stawski et al. | 126/25 B |
| 4,621,984 | 11/1986 | Fussell | 417/411 X |

FOREIGN PATENT DOCUMENTS

| | | | |
|---|---|---|---|
| 2625488 | 8/1977 | Fed. Rep. of Germany | 126/25 B |
| 2583145 | 12/1986 | France | 126/25 B |

*Primary Examiner*—Margaret A. Focarino

[57] ABSTRACT

A fire booster device is provided and consists of a portable air blower with an elongated hollow extension sleeve to guide forced air directly onto a source of a fire. In a modification the extension sleeve is movable and adjustable thereon for greater mobility of the device.

2 Claims, 1 Drawing Sheet

FIREBOOSTER

BACKGROUND OF THE INVENTION

The instant invention relates generally to electric air blowers and more specifically it relates to a fire booster device.

Numerous electric air blowers have been provided in prior art that are adapted to produce a flow of air to enhance combustion of fire or the like. For example, U.S. Pat. Des. Nos. 227,987 and 4,066,061 are illustrative of such prior art. While these units may be suitable for the particular purpose to which they address, they would not be as suitable for the purposes of the present invention as heretofore described.

SUMMARY OF THE INVENTION

A primary object of the present invention is to provide a fire booster device that will overcome the shortcomings of the prior art devices.

Another object is to provide a fire booster device that will aid in building a new fire in fireplaces, wood burning stoves, campfires and charcoal grills.

An additional object is to provide a fire booster device that includes a moveable adjustable extension sleeve so as to precisely place a large amount of oxygen directly into the source of the fire.

A further object is to provide a fire booster device that is simple and easy to use.

A still further object is to provide a fire booster device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
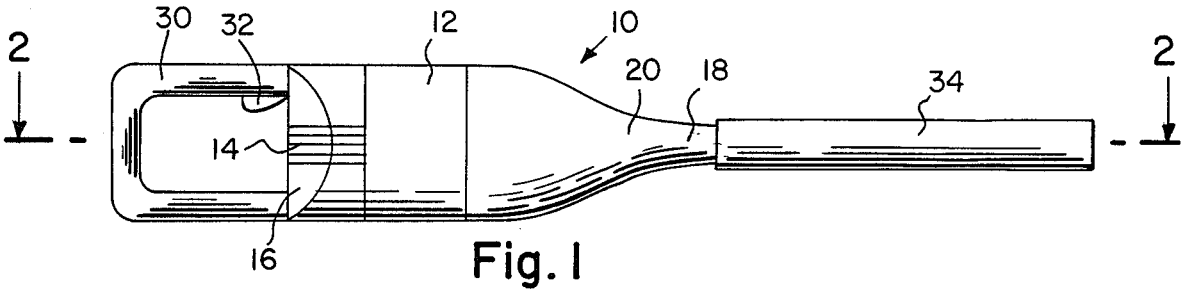
FIG. 1 is a side elevational view of the invention.
Figure 2:
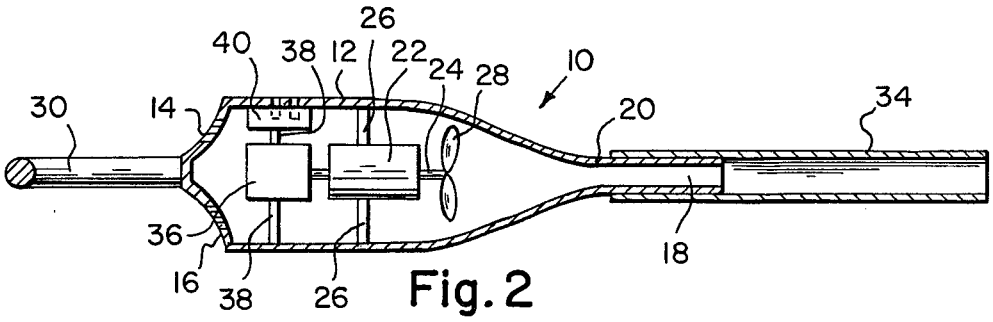
FIG. 2 is a cross sectional view taken along line 2—2 in FIG. 1.

Turning now descriptively to the drawings, in which similar reference characters denote similar elements throughout the several views, FIGS. 1 and 2 illustrate a fire booster device 10 consisting of a casing 12 that has a wide air inlet port 14 at rearward end 16 and a narrow outlet port 18 at forward end 20. A small electric motor 22 with shaft 24 is mounted with struts 26 within the casing 12. A blower fan 28 is mounted to free end of the shaft 24 of the motor 22. A handle 30 is affixed to rearward end 16 of the casing 12 whereby a motor switch 32 which can be a variable speed switch, is mounted within the handle 30. The switch 32 is electrically connected in a circuit to the motor 22 so as to turn the motor on forcing air through the air outlet port 18 of the casing 12. An elongated hollow extension sleeve 34 is disposed onto the air outlet port 18 to guide the forced air directly onto a source of a fire.

The device 10 further contains a portable power source being a battery 36 mounted with struts 38 within the casing 12 and is electrically connected in the circuit to the motor 22. A battery charger 40 is mounted to inside of the casing 12 and is electrically connected in the circuit to the battery 36 for recharging the battery when needed.

Figure 3:
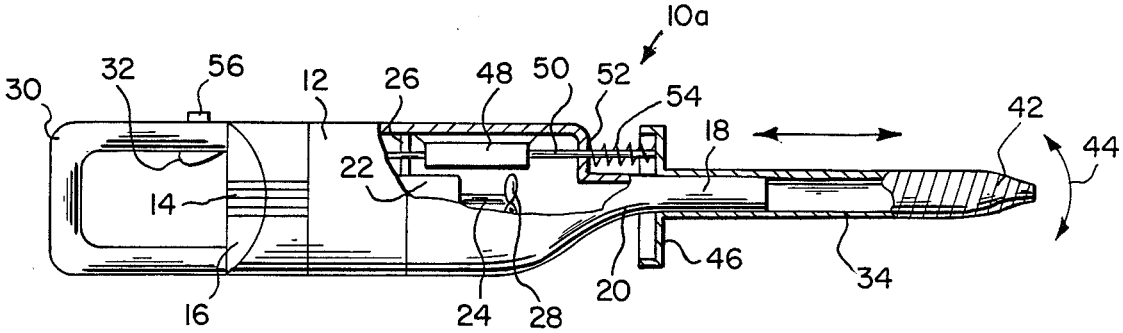
FIG. 3 is a side elevational view with parts broken away of a modification showing an adjustable snake tip extension sleeve.

FIG. 3 shows a flexible bendable snake tip 42 formed on distal end of the extension sleeve 34 to increase the guide capabilities of the extension sleeve 34 whereby the snake tip 42 can be adjusted to any angle therefrom as indicated by arrow 44.

Figure 4:
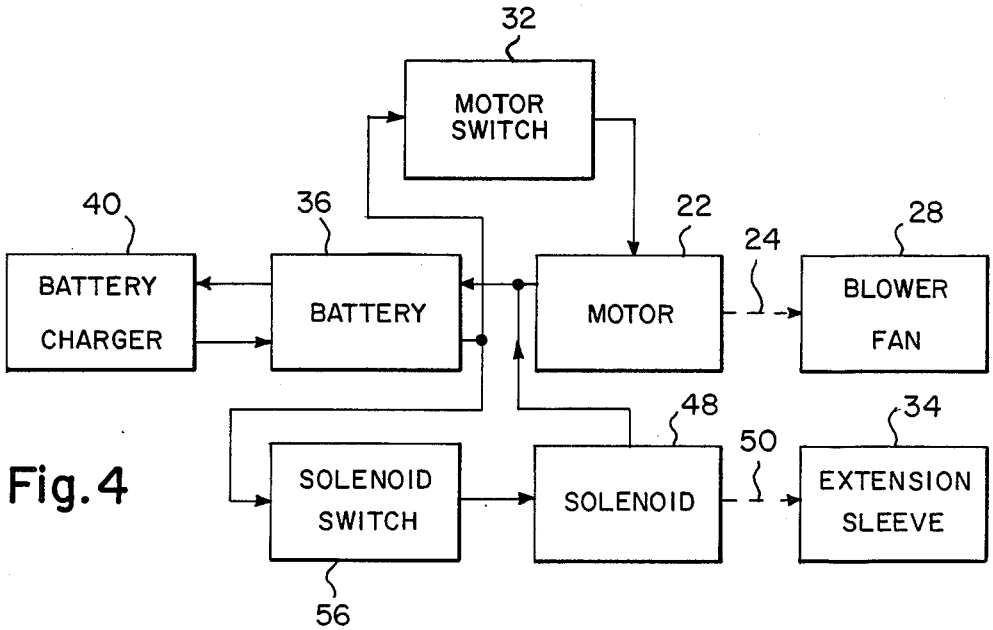
FIG. 4 is a block diagram of the electrical schematic circuit of the modification whereby a solenoid controls movement of the snake tip extension sleeve.

The extension sleeve 34 has a rear flange 46 with the extension sleeve being slideable on the air outlet port 18 of the casing 12. A solenoid 48 with an actuating arm 50 is provided. The solenoid is mounted within the casing 12 so that the actuating arm extends outwardly and forwardly through the casing 12 at 52 and is connected to the flange 46 on the extension sleeve 34. A spring 54 is disposed on the actuating arm 50 of the solenoid 48 between the casing 12 and the flange 46 of the extension sleeve. A solenoid switch 56 is mounted within the handle 30 above the motor switch 32. The solenoid switch 56 is electrically connected in the circuit to the solenoid 48, as indicated in block diagram of FIG. 4, so as to activate the solenoid to slide the extension sleeve 34 on the air outlet port 18 of the casing 12 whereby the extension sleeve can be adjusted to various lengths thereon.

While certain novel features of this invention have been shown and described and are pointed out in the annexed claims, it will be understood that various omissions, substitutions and changes in the forms and details of the device illustrated in its operation can be made by those skilled in the art without departing from the spirit of the invention.

What is claimed is:

1. A firebooster device which comprises:

(a) a casing having an air inlet at a rearward end and an air outlet at a forward end;

(b) a motor with shaft mounted within said casing aligned with said outlet port;

(c) a blower fan mounted on said shaft;

(d) a handle affixed to said rearward end of said casing aligned with said motor shaft;

(e) a motor switch mounted within said handle and electrically connected in a circuit to said motor so as to turn said motor on forcing air through the air outlet port of said casing;

(f) an elongated hollow extension sleeve slidably disposed on said air outlet port to guide the forced air directly onto a source of fire;

(g) means for adjusting automatically the position of said sleeve on said outlet, whereby said means comprises:

(h) said extension sleeve having a rear flange, said extension sleeve being slidable on the air outlet of said casing;

(i) a solenoid with an actuating arm; said solenoid mounted within said casing so that the actuating arm extends outwardly and forwardly through said casing connected to the flange on said extension sleeve;

(j) a spring disposed on the actuating arm of said solenoid between said casing and the flange of said extension sleeve; and (k) a solenoid switch mounted within said handle above said motor switch, said solenoid switch being electrically connected in the circuit to said solenoid so as to activate said solenoid to slide said extension sleeve on the air outlet port of said casing whereby said extension sleeve can be adjusted to various lengths thereon.

2. A fire booster as in claim 1, wherein a flexible tip is provided on the distal end of the sleeve.

* * * * *